US011335224B2

(12) United States Patent
Liu et al.

(10) Patent No.: US 11,335,224 B2
(45) Date of Patent: May 17, 2022

(54) PIXEL CIRCUIT, DRIVING METHOD THEREOF, AND DISPLAY DEVICE

(71) Applicant: BOE Technology Group Co., Ltd., Beijing (CN)

(72) Inventors: Dongni Liu, Beijing (CN); Minghua Xuan, Beijing (CN); Han Yue, Beijing (CN); Li Xiao, Beijing (CN); Liang Chen, Beijing (CN); Hao Chen, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/255,529

(22) PCT Filed: May 7, 2020

(86) PCT No.: PCT/CN2020/088958
§ 371 (c)(1),
(2) Date: Dec. 23, 2020

(87) PCT Pub. No.: WO2020/228581
PCT Pub. Date: Nov. 19, 2020

(65) Prior Publication Data

US 2021/0225224 A1 Jul. 22, 2021

(30) Foreign Application Priority Data

May 14, 2019 (CN) ..... 201910398881.X

(51) Int. Cl.
*G09G 3/00* (2006.01)
*G09G 3/32* (2016.01)

(52) U.S. Cl.
CPC ..... *G09G 3/006* (2013.01); *G09G 3/32* (2013.01); *G09G 2300/0426* (2013.01);
(Continued)

(58) Field of Classification Search
CPC ..... G09G 3/006; G09G 2330/08; G09G 2330/12; G09G 2310/0264;
(Continued)

(56) References Cited

U.S. PATENT DOCUMENTS 7,425,943 B2 9/2008 Furukawa
9,882,174 B2 1/2018 Qu et al.
(Continued)

FOREIGN PATENT DOCUMENTS

CN 1691126 A 11/2005
CN 100397466 C 6/2008
(Continued)

OTHER PUBLICATIONS

First Office Action, including Search Report, for Chinese Patent Application No. 201910398881.X, dated May 6, 2020, 26 pages.

*Primary Examiner* — Gerald Johnson
(74) *Attorney, Agent, or Firm* — Westman, Champlin & Koehler, P.A.

(57) ABSTRACT

A pixel circuit, a driving method thereof, and a display device are provided. The pixel circuit includes: a light-emitting assembly including a plurality of light-emitting elements; a driving sub-circuit electrically coupled to the light-emitting assembly and configured to generate driving current for driving the light-emitting assembly; and a repair sub-circuit electrically coupled to the light-emitting assembly and configured to: receive a repair scanning signal (Gate_R, Gate_Ri) and a repair data signal (Data_R, Data_Ri), and provide the driving current to at least one light-emitting element capable of emitting light normally among the plurality of light-emitting elements under the control of the repair scanning signal (Gate_R, Gate_Ri) and the repair data signal (Data_R, Data_Ri).

13 Claims, 18 Drawing Sheets

(52) U.S. Cl.
CPC ..... *G09G 2310/0267* (2013.01); *G09G 2310/0275* (2013.01); *G09G 2330/10* (2013.01); *G09G 2330/12* (2013.01)

(58) Field of Classification Search
CPC ... G09G 2310/0267; G09G 2310/0275; G09G 3/3266; G09G 2300/0443
See application file for complete search history.

(56) References Cited

U.S. PATENT DOCUMENTS

| | | | | |
|---|---|---|---|---|
| 10,043,788 | B1 | 8/2018 | Han | |
| 10,157,573 | B2 | 12/2018 | Pappas et al. | |
| 10,916,192 | B2 | 2/2021 | Pappas et al. | |
| 2005/0134536 | A1 | 6/2005 | Lo | |
| 2005/0231459 | A1 | 10/2005 | Furukawa | |
| 2006/0238466 | A1 | 10/2006 | Chen et al. | |
| 2012/0056912 | A1 | 3/2012 | Adachi | |
| 2015/0138171 | A1 | 5/2015 | Kim et al. | |
| 2015/0348466 | A1* | 12/2015 | Park | G09G 3/3233 345/205 |
| 2017/0047557 | A1 | 2/2017 | Qu et al. | |
| 2017/0243538 | A1* | 8/2017 | Hwang | G09G 3/3233 |
| 2017/0309224 | A1 | 10/2017 | Pappas et al. | |
| 2018/0174519 | A1 | 6/2018 | Kim et al. | |
| 2018/0226388 | A1 | 8/2018 | Han | |
| 2019/0027094 | A1 | 1/2019 | Pappas et al. | |
| 2021/0134220 | A1 | 5/2021 | Pappas et al. | |

FOREIGN PATENT DOCUMENTS

| | | | |
|---|---|---|---|
| CN | 102446496 | A | 5/2012 |
| CN | 104659058 | A | 5/2015 |
| CN | 105144387 | A | 12/2015 |
| CN | 105161517 | A | 12/2015 |
| CN | 106684098 | A | 5/2017 |
| CN | 206497716 | U | 9/2017 |
| CN | 109416900 | A | 3/2019 |
| CN | 110136637 | A | 8/2019 |
| KR | 20150093909 | A | 8/2015 |

* cited by examiner

PIXEL CIRCUIT, DRIVING METHOD THEREOF, AND DISPLAY DEVICE

CROSS REFERENCE TO RELATED APPLICATIONS

This application is a Section 371 National Stage application of International Application No. PCT/CN2020/088958, filed May 7, 2020, which has not yet published, and claims priority to the Chinese Patent Application No. 201910398881.X filed on May 14, 2019, the contents of which are incorporated herein by reference in their entireties.

TECHNICAL FIELD

The present disclosure relates to the field of display technology, and in particular to a pixel circuit, a driving method thereof, and a display device.

BACKGROUND

Micro Light-Emitting Diode (Micro LED) or Mini Light-Emitting Diode (Mini LED) is expected to become the next generation of mainstream display technology due to its small size, low power consumption and long product life. Therefore, it is necessary to improve a light-emitting brightness of a Micro LED or Mini LED display device and increase a reliability of normal light emission of the Micro LED or Mini LED display device.

SUMMARY

The present disclosure provides a pixel circuit, a driving method of a pixel circuit, and a display device.

According to a first aspect of the present disclosure, there is provided a pixel circuit, including: a light-emitting assembly comprising a plurality of light-emitting elements; a driving sub-circuit electrically coupled to the light-emitting assembly and configured to generate driving current for driving the light-emitting assembly to emit light; and a repair sub-circuit electrically coupled to the light-emitting assembly and configured to: receive a repair scanning signal and a repair data signal, and provide the driving current to at least one light-emitting element capable of emitting light normally among the plurality of light-emitting elements under the control of the repair scanning signal and the repair data signal, to enable the light-emitting assembly to emit light in the presence of a malfunctioning light-emitting element in the plurality of light-emitting elements.

According to an embodiment, the plurality of light-emitting elements are coupled in series.

According to an embodiment, the light-emitting element includes a Micro light-emitting diode or a Mini light-emitting diode.

According to an embodiment, the driving sub-circuit includes a first transistor, a driving transistor and a first capacitor; wherein the first transistor has a control electrode electrically coupled to receive a driving scanning signal, a first electrode electrically coupled to receive a driving data signal, and a second electrode electrically coupled to a control electrode of the driving transistor; the driving transistor has the control electrode electrically coupled to a first end of the first capacitor, a first electrode electrically coupled to the light-emitting assembly, and a second electrode electrically coupled to a first power supply; and the first capacitor has a second end electrically coupled to the first power supply.

According to an embodiment, the light-emitting assembly includes N light-emitting elements, and the repair sub-circuit comprises N repair modules corresponding to the N light-emitting elements one-to-one; an $i^{th}$ repair module is configured to receive an $i^{th}$ repair scanning signal and an $i^{th}$ repair data signal, and provide the driving current to an $i^{th}$ light-emitting element under the control of the $i^{th}$ repair scanning signal and the $i^{th}$ repair data signal, where N is a natural number greater than 1, and $1 \leq i \leq N$.

According to an embodiment, the $i^{th}$ repair module includes: a node control unit electrically coupled to a light-emitting control unit and configured to: receive the $i^{th}$ repair scanning signal and the $i^{th}$ repair data signal, generate a light-emitting control signal based on the $i^{th}$ repair scanning signal and the $i^{th}$ repair data signal, and provide the light-emitting control signal to the light-emitting control unit; and the light-emitting control unit coupled in parallel to both ends of the $i^{th}$ light-emitting element and configured to: receive the light-emitting control signal, and control the driving current to flow through the $i^{th}$ light-emitting element or short circuit the $i^{th}$ light-emitting element under the control of the light-emitting control signal.

According to an embodiment, the node control unit of the $i^{th}$ repair module includes a $(2i)^{th}$ transistor and an $(i+1)^{th}$ capacitor; wherein the $(2i)^{th}$ transistor has a control electrode electrically coupled to receive the $i^{th}$ repair scanning signal, a first electrode electrically coupled to receive the $i^{th}$ repair data signal, and a second electrode electrically coupled to a first end of the $(i+1)^{th}$ capacitor; and the $(i+1)^{th}$ capacitor has a second end electrically coupled to the first power supply.

According to an embodiment, the light-emitting control unit of the $i^{th}$ repair module includes a $(2i+1)^{th}$ transistor; the $(2i+1)^{th}$ transistor has a control electrode electrically coupled to the second electrode of the $(2i)^{th}$ transistor, a first electrode electrically coupled to an anode of the $i^{th}$ light-emitting element, and a second electrode electrically coupled to a cathode of the $i^{th}$ light-emitting element.

According to an embodiment, control electrodes of the $(2i)^{th}$ transistors of the plurality of repair modules are electrically coupled to a control electrode of a first transistor of the driving sub-circuit.

According to an embodiment, first electrodes of the $(2i)^{th}$ transistors of the plurality of repair modules are electrically coupled together.

According to a second aspect of the present disclosure, there is provided a driving method of a pixel circuit, including: generating, by a driving sub-circuit, driving current for driving a light-emitting assembly to emit light; and providing, by a repair sub-circuit, the driving current to at least one light-emitting element capable of emitting light normally among a plurality of light-emitting elements.

According to a third aspect of the present disclosure, there is provided a display device, including a plurality of sub-pixels each including a pixel circuit of the embodiments mentioned above.

According to an embodiment, the display device further includes: a signal read line; a detecting module electrically coupled to the pixel circuit and the signal read line, and configured to output detected current to the signal read line, wherein the detected current corresponds to a brightness of the sub-pixel corresponding to the pixel circuit; and a control module electrically coupled to the signal read line and configured to: identify a light-emitting state of each light-emitting element in the sub-pixel based on the detected current, and provide repair scanning signals and repair data signals to a plurality of repair modules of the pixel circuit based on the light-emitting state of each light-emitting element.

According to an embodiment, the detecting module includes a $(2N+2)^{th}$ transistor and a photodiode, where N is a natural number greater than 1; and wherein the $(2N+2)^{th}$ transistor has a control electrode electrically coupled to receive a detection scanning signal, a first electrode electrically coupled to an anode of the photodiode, and a second electrode electrically coupled to the signal read line; and the photodiode has a cathode electrically coupled to a second power supply.

BRIEF DESCRIPTION OF THE DRAWINGS

The drawings are used to provide a further understanding of the present disclosure and constitute a part of the specification. Together with the embodiments of the present disclosure, the drawings are used to explain the technical solutions of the present disclosure, but do not constitute a limitation to the present disclosure.

FIG. 11C shows an operation sequence diagram of the pixel circuit provided in FIG. 10 in which only a first light-emitting element is capable of emitting light normally;

DETAILED DESCRIPTION

Figure 1:
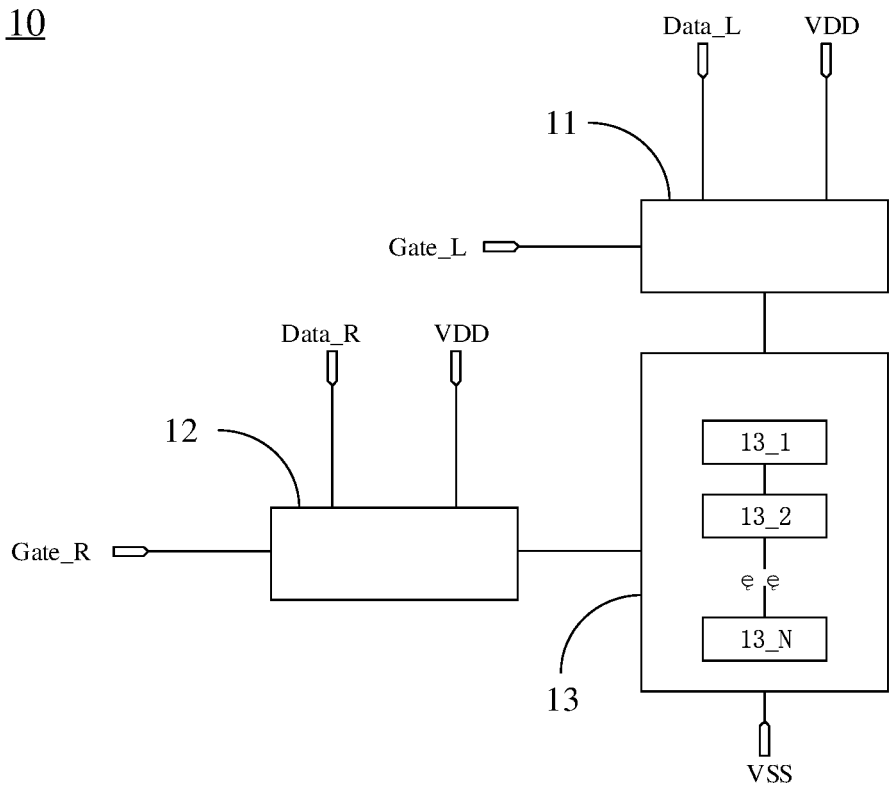
FIG. 1 shows a schematic structural diagram of a pixel circuit provided by an embodiment of the present disclosure.

The present disclosure describes a number of embodiments, but the description is exemplary rather than restrictive, and it is obvious to those ordinary skilled in the art that there may be more embodiments and implementations within the scope contained in the embodiments described in the present disclosure. Although many possible feature combinations are shown in the drawings and discussed in the specific embodiments, many other combinations of the features disclosed are also possible. Unless specifically limited, any feature or element of any embodiment may be used in combination with any other feature or element in any other embodiment, or may replace any other feature or element in any other embodiment.

The present disclosure includes and contemplates combinations with features and elements known to those ordinary skilled in the art. The embodiments, features and elements disclosed in the present disclosure may also be combined with any conventional features or elements to form a unique invention solution defined by the claims. Any feature or element of any embodiment may also be combined with features or elements from other inventive solutions to form another unique invention solution defined by the claims. Therefore, it should be understood that any feature shown and/or discussed in the present disclosure may be implemented individually or in any suitable combination. Therefore, the embodiments are not limited except for the limitations made according to the appended claims and their equivalents. In addition, various modifications and changes may be made within the protection scope of the appended claims.

In addition, in describing representative embodiments, the specification may have presented a method and/or process as a specific sequence of steps. However, to the extent that the method or process does not depend on the specific order of the steps described herein, the method or process should not be limited to the steps in the specific order described. As understood by those ordinary skilled in the art, other orders of steps are also possible. Therefore, the specific order of steps set forth in the specification should not be construed as a limitation to the claims. In addition, the claims for the method and/or process should not be limited to performing the steps thereof in the written orders. Those skilled in the art may easily understand that these orders may be changed and still remain within the spirit and scope of the embodiments of the present disclosure.

Unless otherwise defined, technical terms or scientific terms used in the embodiments of the present disclosure shall be of the general meaning understood by those ordinary skilled in the field to which the present invention pertains. The words "first," "second," and the like used in the embodiments of the present disclosure do not indicate any order, quantity or importance, but are only used to distinguish different composition parts. The words "including," "comprising," and the like mean that the elements or objects appearing before the word cover the elements or objects listed after the word and their equivalents, but do not exclude other elements or objects. The words "coupled," "connected," and the like are not limited to physical or mechanical connections, but may include electrical connections, whether direct or indirect.

A source and a drain of a transistor used in all the embodiments of the present disclosure are symmetrical, so the source and drain are interchangeable. In the embodiments of the present disclosure, in order to distinguish two electrodes of a transistor other than a gate, a source is referred to as a first electrode, a drain is referred to as a second electrode, and a gate is referred to as a control electrode. In addition, the transistors used in the embodiments of the present disclosure include P-type transistors and N-type transistors. The P-type transistor is turned on when the gate is at a low level and turned off when the gate is at a high level. The N-type transistor is turned on when the gate is at a high level and turned off when the gate is at a low level.

Some embodiments of the present disclosure provide a pixel circuit. FIG. 1 shows a schematic structural diagram of a pixel circuit 10 provided by an embodiment of the present disclosure. As shown in FIG. 1, the pixel circuit 10 provided by the embodiment of the present disclosure includes a driving sub-circuit 11, a repair sub-circuit 12 and a light-emitting assembly 13.

The light-emitting assembly 13 includes a plurality of light-emitting elements. As shown in FIG. 1, the light-emitting assembly 13 includes N light-emitting elements coupled in series, where N is a natural number greater than 2, and a value of N may be determined according to actual needs. For ease of description, an $i^{th}$ light-emitting element coupled in series is represented by 13_*i*, where i is a natural number, and $1 \leq i \leq N$. According to the embodiment, the light-emitting element may include a Micro light-emitting diode or a Mini light-emitting diode, but the present disclosure is not limited thereto, and the light-emitting element may also be of other types.

As shown in FIG. 1, the driving sub-circuit 11 is electrically coupled to the light-emitting assembly 13. The driving sub-circuit 11 is configured to receive a driving scanning signal Gate_L and a driving data signal Data_L, and generate driving current for driving the light-emitting assembly 13 to emit light, based on the driving scanning signal Gate_L and the driving data signal Data_L.

As shown in FIG. 1, the repair sub-circuit 12 is electrically coupled to the light-emitting assembly 13. The repair sub-circuit 12 is configured to receive a repair scanning signal Gate_R and a repair data signal Data_R, and provide, under the control of the repair scanning signal Gate_R and the repair data signal Data_R, the driving current generated by the driving sub-circuit 11 to at least one light-emitting element capable of emitting light normally among the plurality of light-emitting elements, so as to enable the light-emitting assembly 13 to emit light in the presence of a malfunctioning light-emitting element in the plurality of light-emitting elements.

In addition, as shown in FIG. 1, a first power supply VDD continuously provides a high-level signal, and a second power supply VSS continuously provides a low-level signal. However, the present disclosure is not limited to this.

It should be noted that a display product according to the embodiment of the present disclosure includes a plurality of pixels, each including three sub-pixels. The pixel circuit 10 provided by the embodiment of the present disclosure corresponds to each of the sub-pixels one-to-one.

Figure 2:
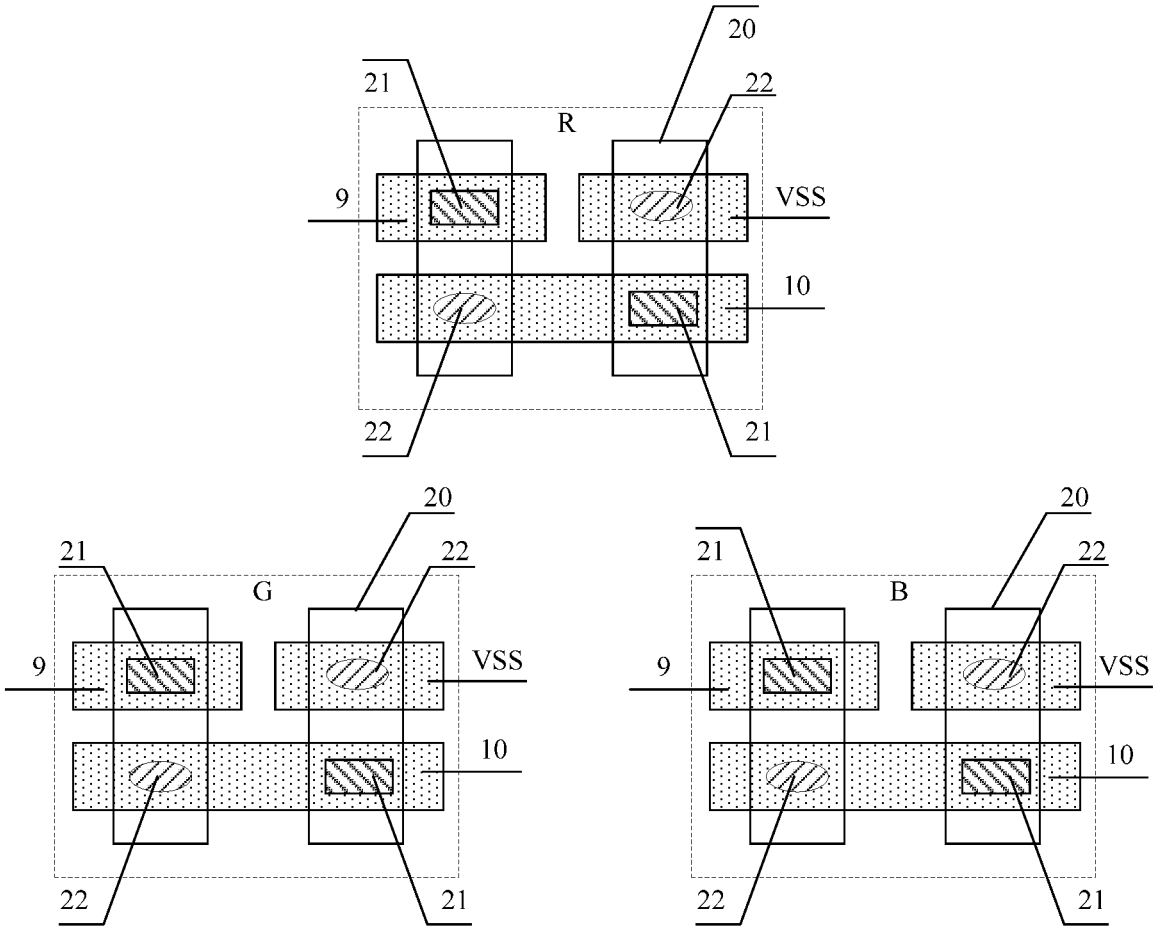
FIG. 2 shows a top view of a connection of a light-emitting assembly provided by an embodiment of the present disclosure.

FIG. 2 shows a top view of a connection of the light-emitting assembly provided by an embodiment of the present disclosure. As shown in FIG. 2, the pixels provided by the embodiment of the present disclosure include a red sub-pixel R, a green sub-pixel G, and a blue sub-pixel B. Each sub-pixel includes a drain 9 of a thin film transistor electrically coupled to one end of the light-emitting assembly 13, and the second power supply VSS electrically coupled to the other end of the light-emitting assembly 13. The light-emitting assembly 13 includes two light-emitting elements 20, and each light-emitting element includes an anode 21 and a cathode 22. The anode 21 of a first light-emitting element is electrically coupled to the drain 9 of the thin film transistor in the pixel circuit, the cathode 22 of the first light-emitting element is electrically coupled to the anode 21 of a second light-emitting element through a connection line 10, and the cathode 22 of the second light-emitting element is electrically coupled to the second power supply VSS. That is, the first light-emitting element is coupled in series with the second light-emitting element. It should be noted that the case where each sub-pixel is electrically coupled to two light-emitting elements is illustrated by way of example in describing the embodiment of the present disclosure, but the present disclosure is not limited to this.

The light-emitting assembly in the pixel circuit provided by the embodiment of the present disclosure includes a plurality of light-emitting elements coupled in series. In a state where each light-emitting element is capable of emitting light normally, the plurality of light-emitting elements in each sub-pixel emit light at the same time, which may increase a light-emitting brightness of the sub-pixel. Correspondingly, under a condition that the light-emitting brightness of the sub-pixel is unchanged, the driving current may be reduced by reducing a size of the thin film transistor or reducing a source-drain voltage difference of the thin film transistor, which may not only reduce trace heating but also reduce a thermal effect on the light-emitting elements and a power consumption of the display product. Further, a resolution of the display product may be improved. The repair sub-circuit of the pixel circuit provided by the embodiment of the present disclosure may provide the driving current to the light-emitting element capable of emitting light normally in the presence of a light-emitting element that fails to emit light normally, so as to achieve the light emission of the sub-pixel corresponding to the pixel circuit.

In the embodiment of the present disclosure, by providing the repair sub-circuit in the pixel circuit, the sub-pixel corresponding to the pixel circuit may emit light normally as long as one of the light-emitting elements in the pixel circuit is capable of emitting light normally, so as to solve the technical problem that the sub-pixel corresponding to the pixel circuit fails to emit light normally only if one of the light-emitting elements in the pixel circuit fails to emit light normally, which improves a display quality of the display product and further improves a yield rate of the display product.

Figure 3:
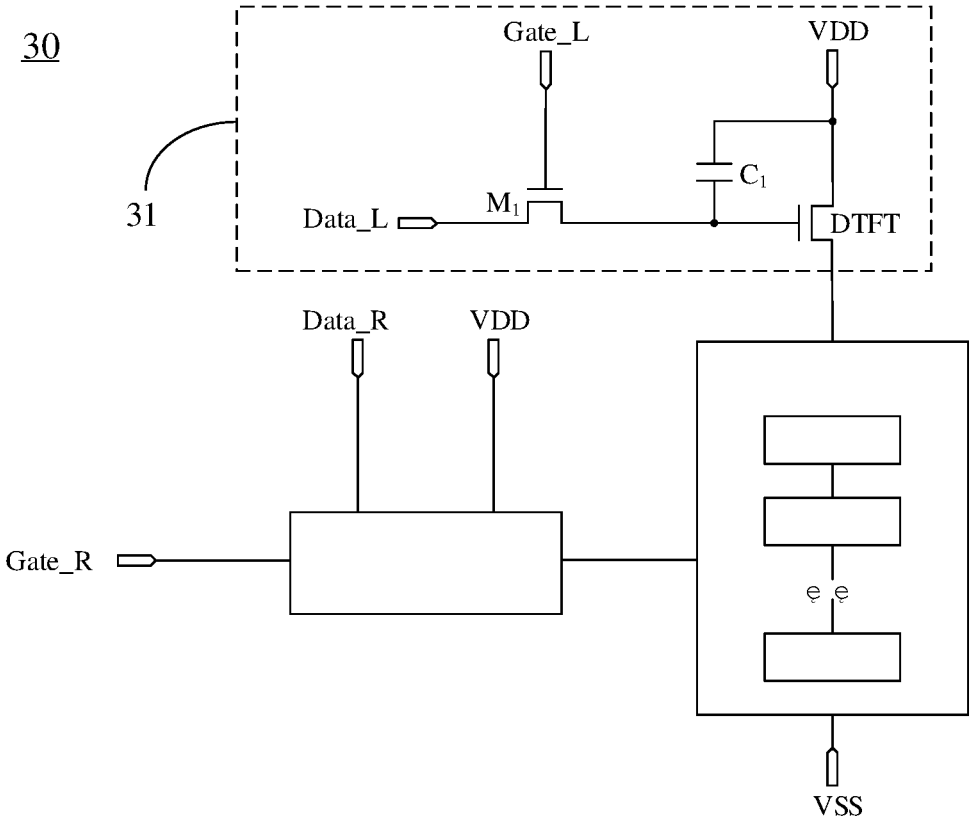
FIG. 3 shows an equivalent circuit diagram of a driving sub-circuit provided by an embodiment of the present disclosure.

FIG. 3 shows an equivalent circuit diagram of a driving sub-circuit provided by an embodiment of the present disclosure. As shown in FIG. 3, a driving sub-circuit 31 in a pixel circuit 30 provided by the embodiment of the present disclosure includes a first transistor M1, a driving transistor DTFT and a first capacitor C1.

As shown in FIG. 3, the first transistor M1 has a control electrode electrically coupled to receive the driving scanning signal Gate_L, a first electrode electrically coupled to receive the driving data signal Data_L, and a second electrode electrically coupled to a control electrode of the driving transistor DTFT. The driving transistor DTFT has the control electrode electrically coupled to a first end of the first capacitor C1, a first electrode electrically coupled to the light-emitting assembly, and a second electrode electrically coupled to the first power supply VDD. The first capacitor C1 has a second end electrically coupled to the first power supply VDD.

The driving transistor DTFT in the embodiment may be an enhancement transistor or a depletion transistor, which is not specifically limited here.

It should be noted that an exemplary structure of the driving sub-circuit 31 is specifically shown in FIG. 3. It is easily understood by those skilled in the art that an implementation of the driving sub-circuit 31 is not limited to this, and may also be other circuits commonly used by those skilled in the art, as long as its function may be achieved.

Figure 4:
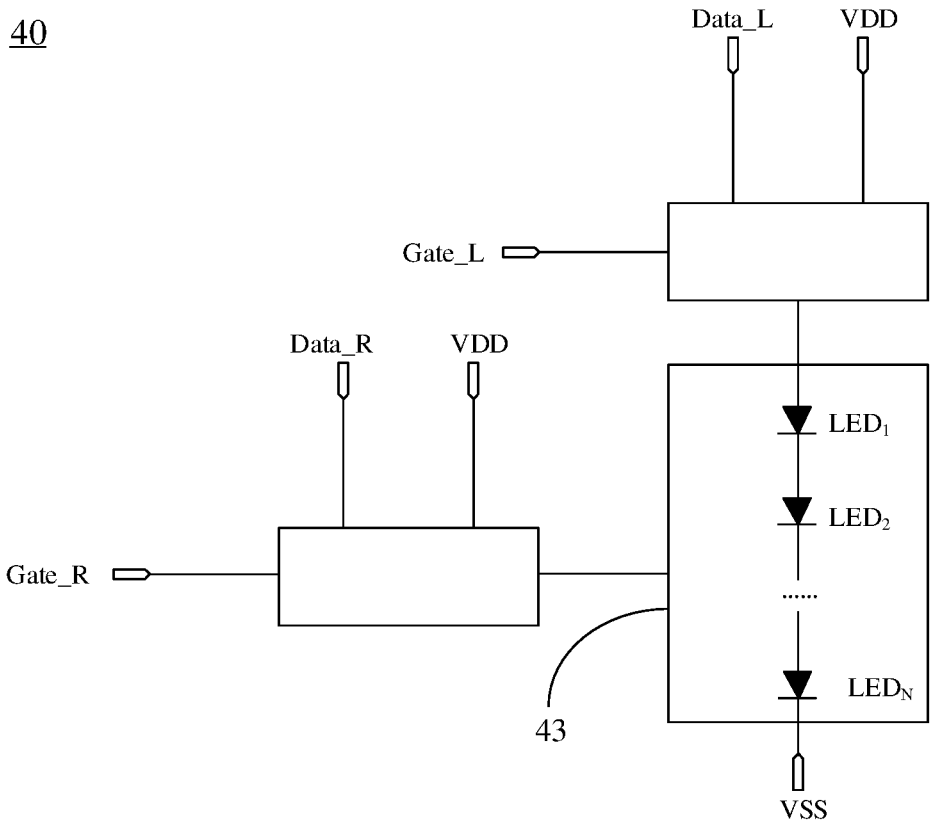
FIG. 4 shows an equivalent circuit diagram of a light-emitting assembly provided by an embodiment of the present disclosure.

FIG. 4 shows an equivalent circuit diagram of a light-emitting assembly provided by an embodiment of the present disclosure. As shown in FIG. 4, a light-emitting assembly in the pixel circuit provided by the embodiment of the present disclosure includes N light-emitting elements $LED_1$ to $LED_N$ coupled in series.

As shown in FIGS. 3 and 4, an anode of the first light-emitting element $LED_1$ is electrically coupled to the first electrode of the driving transistor DTFT, a cathode of the Nth light-emitting element $LED_N$ is electrically coupled to the second power supply VSS, and so on, a cathode of an $i^{th}$ light-emitting element $LED_i$ is electrically coupled to an anode of an $(i+1)^{th}$ light-emitting element $LED_{i+1}$, where $1 \le i \le N-1$.

Figure 5:
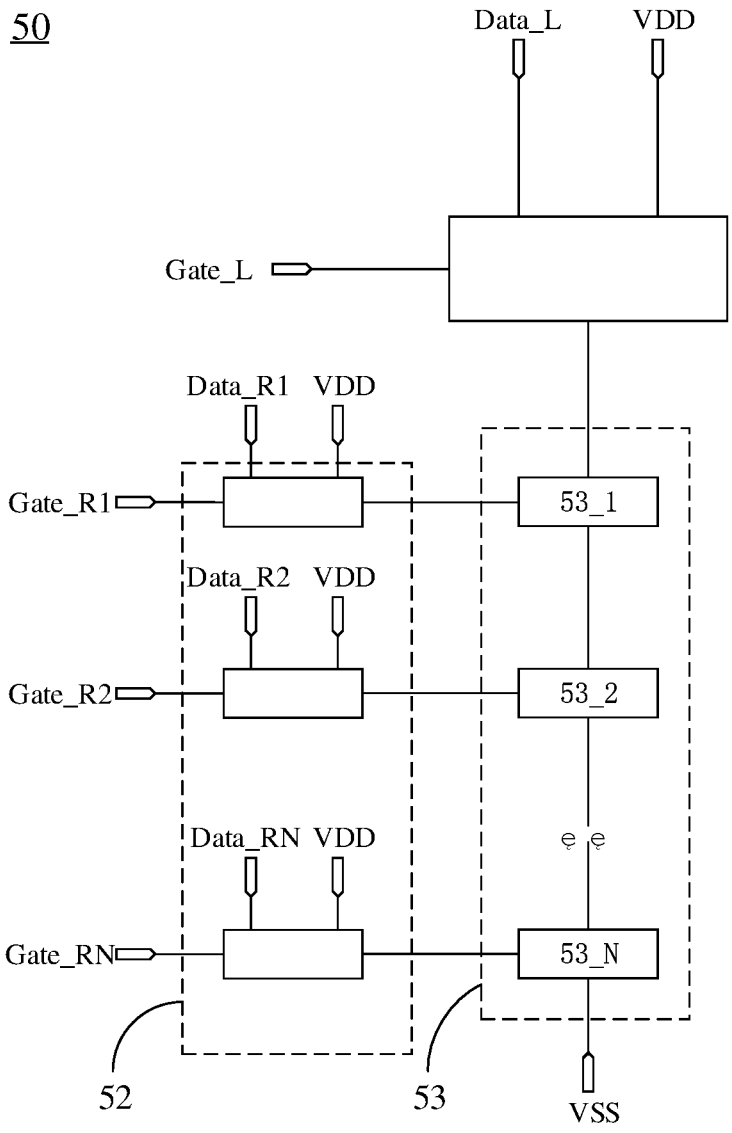
FIG. 5 shows a schematic structural diagram of a repair sub-circuit provided by an embodiment of the present disclosure.

FIG. 5 shows a schematic structural diagram of a repair sub-circuit provided by an embodiment of the present disclosure. As shown in FIG. 5, in a pixel circuit 50 provided by the embodiment of the present disclosure, a light-emitting assembly 53 includes N light-emitting elements, and a repair sub-circuit 52 includes N repair modules corresponding to the N light-emitting elements one-to-one.

As shown in FIG. 5, an $i^{th}$ repair module is electrically coupled to the $i^{th}$ light-emitting element and is electrically coupled to receive an $i^{th}$ repair scanning signal Gate_Ri and an $i^{th}$ repair data signal Data_Ri, and is configured to provide the driving current to the $i^{th}$ light-emitting element $LED_i$ under the control of the $i^{th}$ repair scanning signal Gate_Ri and the $i^{th}$ repair data signal Data_Ri, in a state where the $i^{th}$ light-emitting element emits light normally, and to short circuit the $i^{th}$ light-emitting element $LED_i$ under the control of the $i^{th}$ repair scanning signal Gate_Ri and the $i^{th}$ repair data signal Data_Ri, in a state where the $i^{th}$ light-emitting element $LED_i$ fails to emit light normally, where $1 \le i \le N$.

Figure 6:
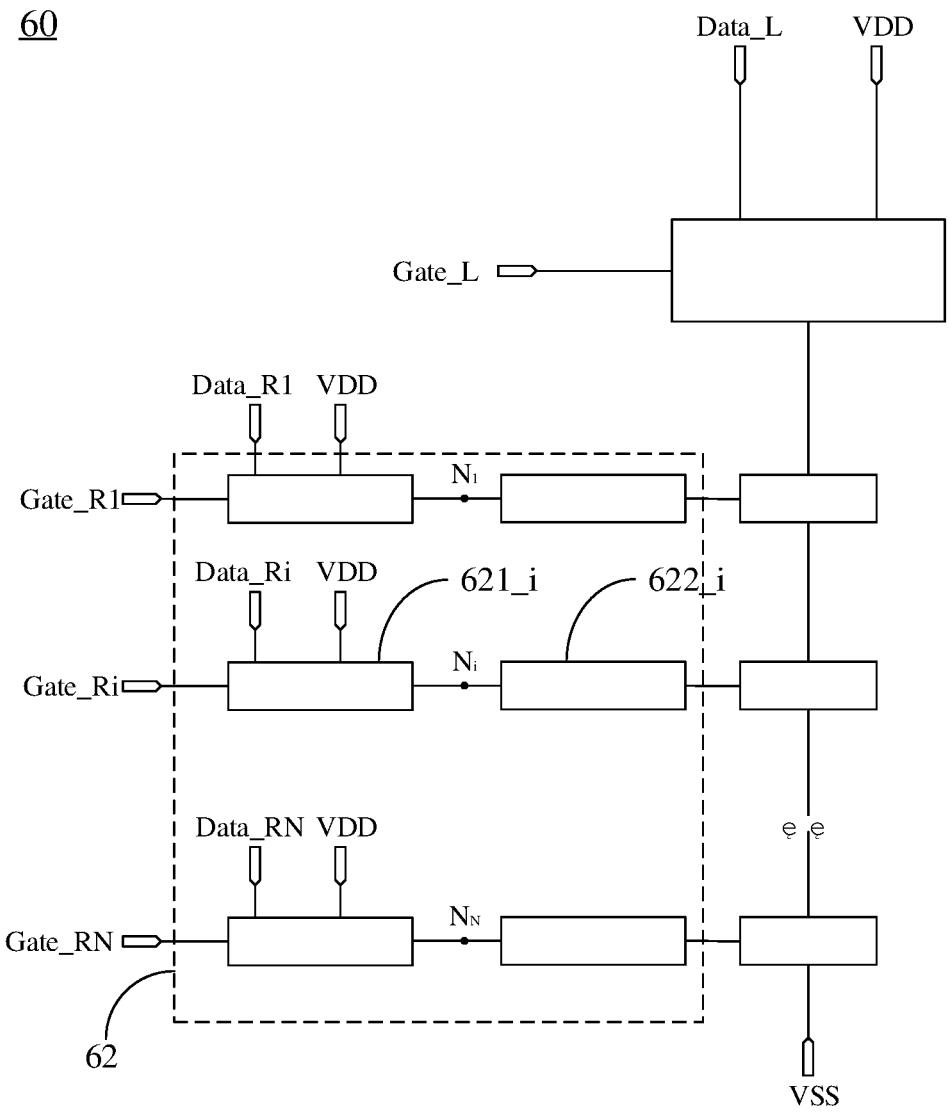
FIG. 6 shows a schematic structural diagram of a repair module provided by an embodiment of the present disclosure.

FIG. 6 shows a schematic structural diagram of a repair module provided by an embodiment of the present disclosure. As shown in FIG. 6, in a pixel circuit 60 provided by the embodiment of the present disclosure, an $i^{th}$ repair module includes a node control unit 621_*i* and a light-emitting control unit 622_*i*. The node control unit 621_*i* is electrically coupled to the light-emitting control unit 622_*i* at an $i^{th}$ node $N_i$.

As shown in FIG. 6, the node control unit 621_*i* is configured to receive the $i^{th}$ repair scanning signal Gate_Ri and the $i^{th}$ repair data signal Data_Ri, generate a light-emitting control signal based on the $i^{th}$ repair scanning signal Gate_Ri and the $i^{th}$ repair data signal Data_Ri, and provide the light-emitting control signal generated to the light-emitting control unit 622_*i*. According to the embodiment, the node control unit 621_*i* may provide the $i^{th}$ repair data signal Data_Ri to the $i^{th}$ node $N_i$ under the control of the $i^{th}$ repair scanning signal Gate_Ri, or maintain potential of a signal of the $i^{th}$ node $N_i$, so as to control the light-emitting control unit 622_*i*.

As shown in FIG. 6, the light-emitting control unit 622_*i* is coupled to the $i^{th}$ node $N_i$ and the $i^{th}$ light-emitting element $LED_i$ respectively, and is configured to: receive the light-emitting control signal generated by the node control unit 621_*i*, and, under the control of the light-emitting control signal, provide the driving current to the $i^{th}$ light-emitting element $LED_i$ in a state where the $i^{th}$ light-emitting element $LED_i$ emits light normally, or short circuit the $i^{th}$ light-emitting element $LED_i$ in a state where the $i^{th}$ light-emitting element $LED_i$ fails to emit light normally.

Figure 7:
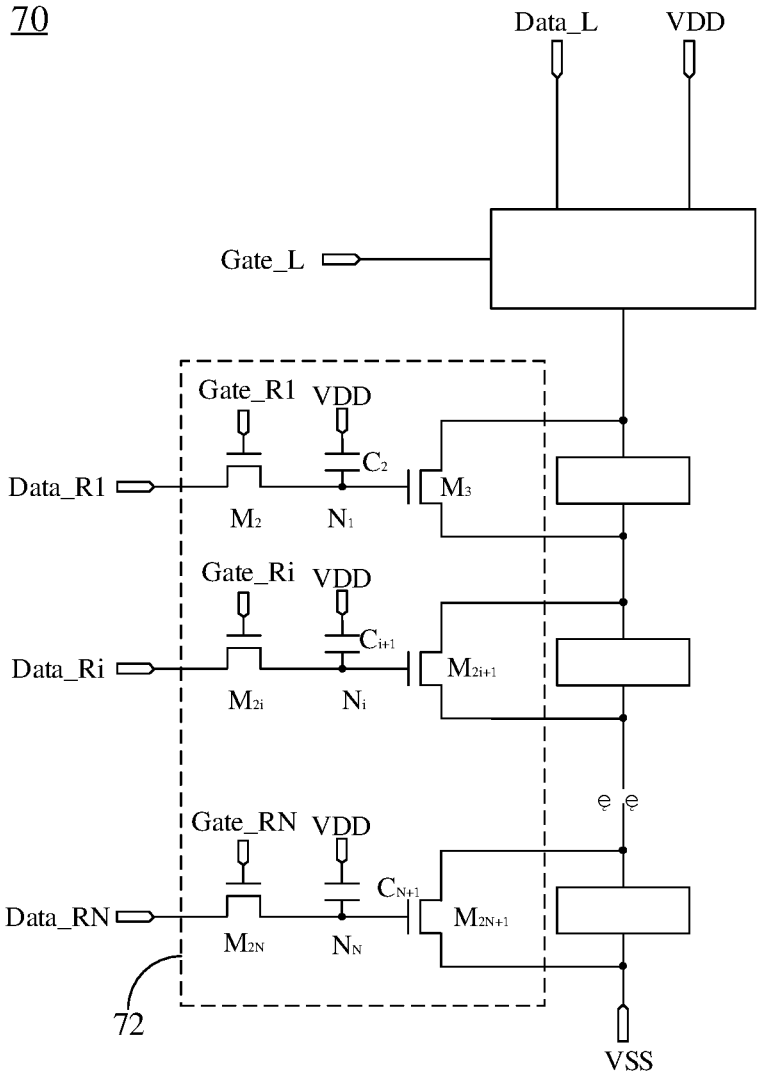
FIG. 7 shows an equivalent circuit diagram of a repair sub-circuit provided by an embodiment of the present disclosure.

FIG. 7 shows an equivalent circuit diagram of a repair sub-circuit provided by an embodiment of the present disclosure. As shown in FIG. 7, the node control unit of the $i^{th}$ repair module includes a $(2i)^{th}$ transistor $M_{2i}$ and an $(i+1)^{th}$ capacitor $C_{i+1}$, and the light-emitting control unit of the $i^{th}$ repair module includes a $(2i+1)^{th}$ transistor $M_{2i+1}$. As shown in FIG. 7, the light-emitting control unit of the $i^{th}$ repair module is coupled in parallel to both ends of the $i^{th}$ light-emitting element.

As shown in FIG. 7, the $(2i)^{th}$ transistor $M_{2i}$ has a control electrode electrically coupled to receive the $i^{th}$ repair scanning signal Gate_Ri, a first electrode electrically coupled to receive the $i^{th}$ repair data signal Data_Ri, and a second electrode electrically coupled to a first end of the $(i+1)^{th}$ capacitor $C_{i+1}$ at the $i^{th}$ node $N_i$. A second end of the $(i+1)^{th}$ capacitor $C_{i+1}$ is electrically coupled to the first power supply VDD. The $(2i+1)^{th}$ transistor $M_{2i+1}$ has a control electrode electrically coupled to the second electrode of the $(2i)^{th}$ transistor $M_{2i}$ at the $i^{th}$ node $N_i$, a first electrode electrically coupled to the anode of the $i^{th}$ light-emitting element $LED_i$, and a second electrode electrically coupled to the cathode of the $i^{th}$ light-emitting element $LED_i$.

It should be noted that FIG. 7 specifically shows an exemplary structure of the repair sub-circuit. It is easily understood by those skilled in the art that the implementation of the driving sub-circuit is not limited to this, and may also be other circuits commonly used by those skilled in the art, as long as its function may be achieved.

Figure 8:
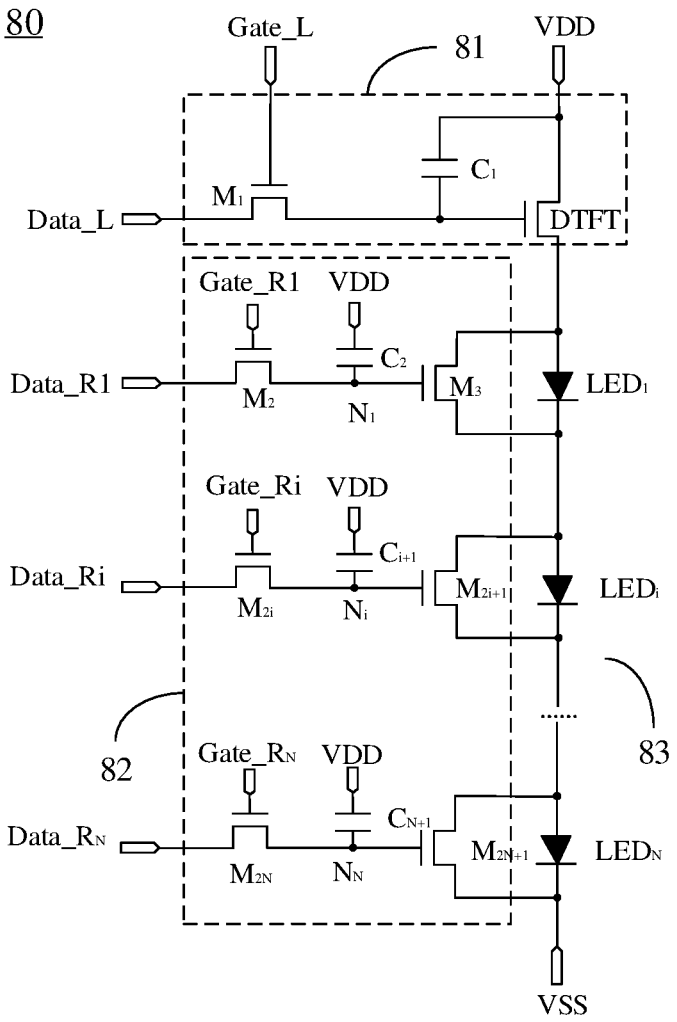
FIG. 8 shows an equivalent circuit diagram of a pixel circuit provided by an embodiment of the present disclosure.

FIG. 8 shows a schematic structural diagram of a pixel circuit provided by an embodiment of the present disclosure. As shown in FIG. 8, in a pixel circuit 80 provided by the embodiment of the present disclosure, the driving sub-circuit 81 includes a first transistor $M_1$, a driving transistor DTFT and a first capacitor $C_1$. The repair sub-circuit 82 includes a second transistor $M_2$ to a $(2N+1)^{th}$ transistor $M_{2N+1}$ and a second capacitor $C_2$ to an $(N+1)^{th}$ capacitor $C_{N+1}$. The light-emitting assembly 83 includes N light-emitting elements $LED_1$ to $LED_N$.

As shown in FIG. 8, a first transistor $M_1$ has a control electrode electrically coupled to receive the driving scanning signal Gate_L, a first electrode electrically coupled to receive the driving data signal Data_L, and a second electrode electrically coupled to a control electrode of the driving transistor DTFT. The driving transistor DTFT has a control electrode electrically coupled to a first end of the first capacitor $C_1$, a first electrode electrically coupled to a first light-emitting element $LED_1$, and a second electrode electrically coupled to the first power supply VDD. The first capacitor $C_1$ has a second end electrically coupled to the first power supply VDD. A $(2i)^{th}$ transistor $M_{2i}$ has a control electrode electrically coupled to receive an $i^{th}$ repair scanning signal Gate_Ri, a first electrode electrically coupled to receive an $i^{th}$ repair data signal Data_Ri, and a second electrode electrically coupled to an $i^{th}$ node $N_i$. A $(2i+1)^{th}$ transistor $M_{2i+1}$ has a control electrode electrically coupled to the $i^{th}$ node $N_i$, a first electrode electrically coupled to an anode of an $i^{th}$ light-emitting element $LED_i$, and a second electrode electrically coupled to a cathode of the $i^{th}$ light-emitting element $LED_i$. An $(i+1)^{th}$ capacitor $C_{i+1}$ has a first end electrically coupled to the $i^{th}$ node $N_i$, and a second end electrically coupled to the first power supply VDD. A cathode of an $N^{th}$ light-emitting element $LED_N$ is electrically coupled to the second power supply VSS, where $1 \leq i \leq N$.

Figure 9:
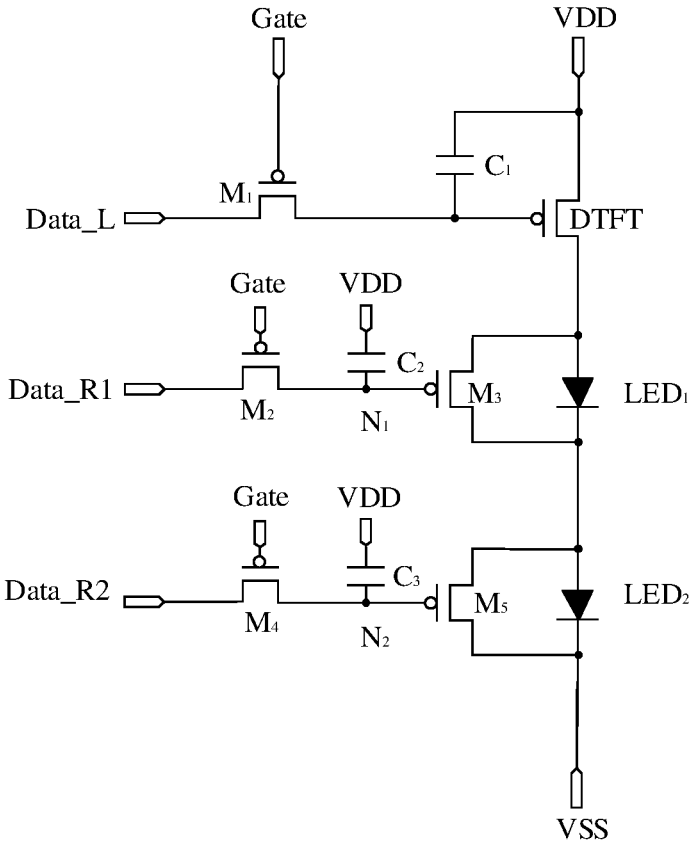
FIG. 9 shows an equivalent circuit diagram of a pixel circuit provided by an embodiment of the present disclosure.

FIG. 9 shows an equivalent circuit diagram of a pixel circuit provided by an embodiment of the present disclosure. As shown in FIG. 9, control electrodes of the $(2i)^{th}$ transistors of the plurality of repair modules are electrically coupled to the control electrode of the first transistor of the driving sub-circuit. It should be noted that FIG. 9 is illustrated with N=2 as an example, and the embodiment of the present disclosure is not limited to this.

Figure 10:
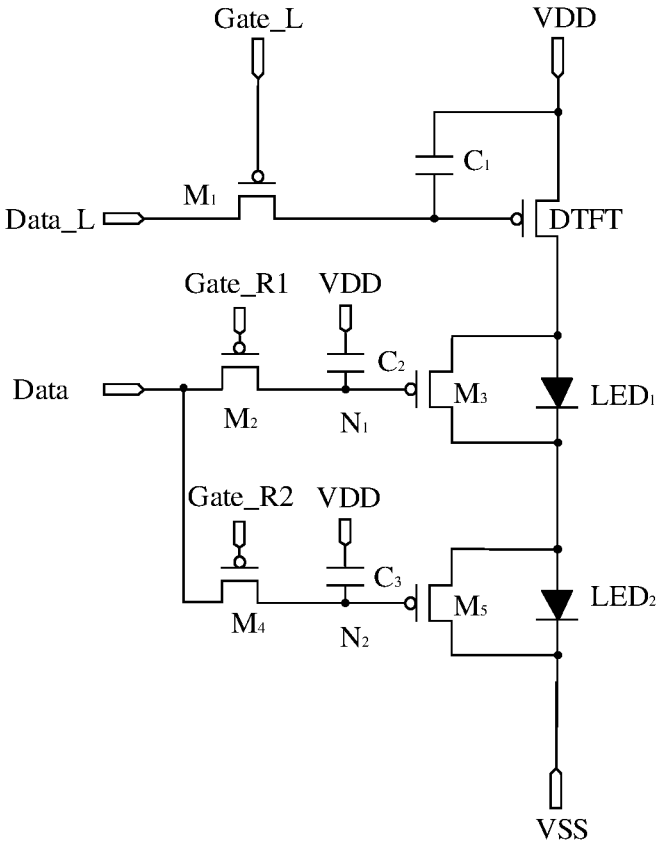
FIG. 10 shows another equivalent circuit diagram of the pixel circuit provided by an embodiment of the present disclosure.

FIG. 10 shows another equivalent circuit diagram of a pixel circuit provided by an embodiment of the present disclosure. As shown in FIG. 10, first electrodes of the $(2i)^{th}$ transistors of the plurality of repair modules are electrically coupled together. It should be noted that FIG. 10 is illustrated with N=2 as an example, and the embodiment of the present disclosure is not limited to this. According to the embodiment shown in FIG. 10, wirings in the pixel circuit may be reduced.

In this embodiment, the transistors $M_1$ to $M_{2N+1}$ may all be N-type thin film transistors or P-type thin film transistors, which may unify a process flow, reduce number of processes, and improve a product yield rate. In addition, considering that leakage current of low-temperature polysilicon thin-film transistors is low, all transistors of the embodiments of the present disclosure are preferably low-temperature polysilicon thin-film transistors. The thin-film transistors may specifically be selected from bottom-gate thin-film transistors or top-gate thin-film transistors, as long as a switch function may be achieved.

Figure 11A:
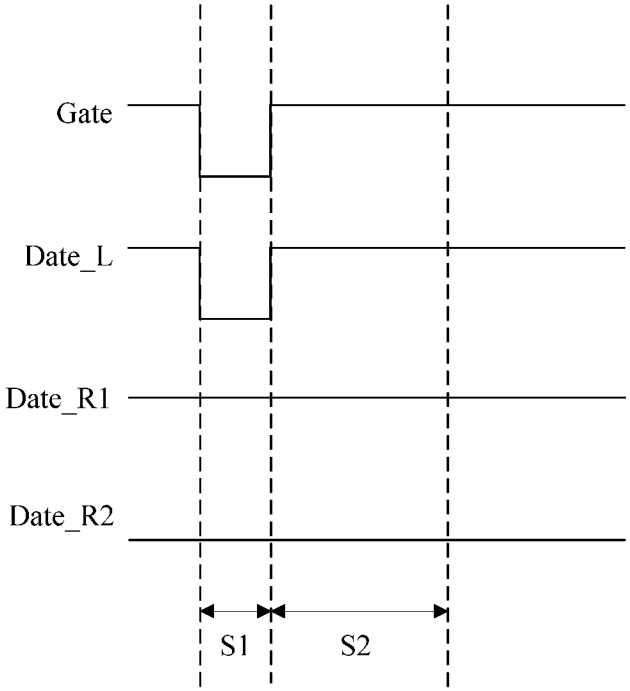
FIG. 11A shows an operation sequence diagram of the pixel circuit provided in FIG. 9 in which two light-emitting elements emit light normally.
Figure 11B:
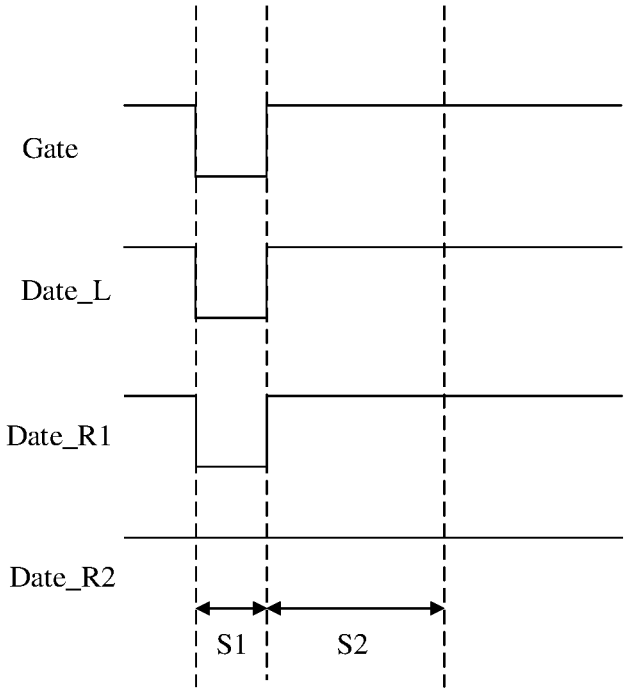
FIG. 11B shows an operation sequence diagram of the pixel circuit provided in FIG. 9 in which only a second light-emitting element is capable of emitting light normally.
Figure 11C:
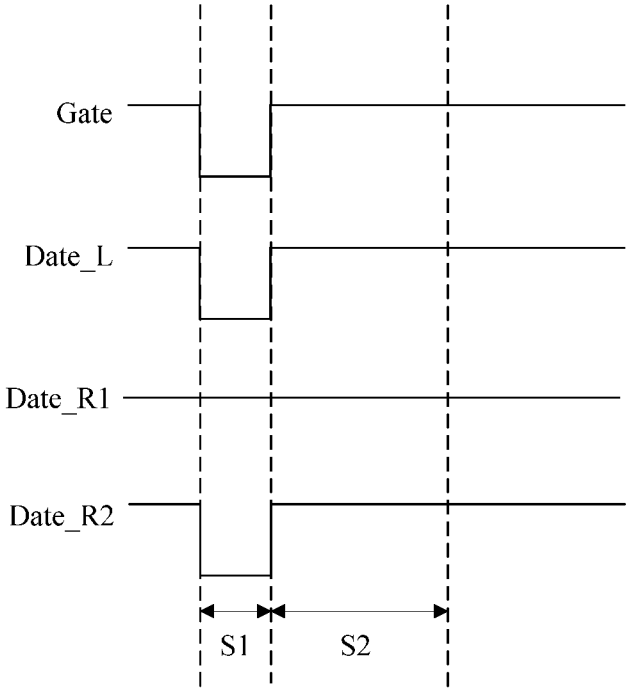
FIG. 11C shows an operation sequence diagram of the pixel circuit provided in FIG. 9 in which only a first light-emitting element is capable of emitting light normally.

Taking the pixel circuit provided in FIG. 9 as an example, where N=2 and transistors $M_1$ to $M_5$ are all P-type thin film transistors, FIG. 11A shows an operation sequence diagram of the pixel circuit provided in FIG. 9 in which two light-emitting elements emit light normally, FIG. 11B shows an operation sequence diagram of the pixel circuit provided in FIG. 9 in which only a second light-emitting element is capable of emitting light normally, and FIG. 11C shows an operation sequence diagram of the pixel circuit provided in FIG. 9 in which only a first light-emitting element is capable of emitting light normally. As shown in FIG. 9, the pixel circuit involved in the embodiment of the present disclosure includes five switch transistors ($M_1$~$M_5$), one driving transistor (DTFT) and three capacitor units ($C_1$~$C_3$).

In addition, the first power supply VDD continuously provides a high-level signal, and the second power supply VSS continuously provides a low-level signal.

When both the light-emitting elements $LED_1$ and $LED_2$ in the pixel circuit emit light normally, in combination with FIG. 9 and FIG. 11A, the operation sequence of the pixel circuit includes a first stage S1 and a second stage S2. The first stage S1 is also referred to as an input stage, and the second stage S2 is also referred to as a light-emitting stage.

In the first stage S1 and the second stage S2, an input signal Gate is at a low level, so that the first transistor $M_1$, the second transistor $M_2$ and the fourth transistor $M_4$ are continuously turned on. The driving data signal Data_L applied to the control electrode of the driving transistor DTFT is at a low level, so that the driving transistor DTFT is turned on and outputs driving current. A first repair data signal Data_R1 and a second repair data signal Data_R2 are continuously at a high level, and the high level is applied to the first node $N_1$ and the second node $N_2$, that is, to the control electrodes of the third transistor $M_3$ and the fifth transistor $M_5$, so that the third transistor $M_3$ and the fifth transistor $M_5$ are turned off. The driving current flows through the first light-emitting element $LED_1$ and the second light-emitting element $LED_2$, so that both the first light-emitting element $LED_1$ and the second light-emitting element $LED_2$ emit light.

In this case, the input signal Gate and the driving data signal Data_L are both low-level signals, and the first repair data signal Data_R1 and the second repair data signal Data_R2 are both high-level signals. In other words, when each light-emitting element in the light-emitting assembly of the pixel circuit is capable of emitting light normally, both the first repair data signal Data_R1 and the second repair data signal Data_R2 output invalid level (high level), that is, the repair sub-circuit does not operate.

It should be noted that this embodiment is described with N=2 as an example. When N is greater than 2, and all of N light-emitting elements in the pixel circuit emit light normally, the N repair data signals Data_R1~Data_RN continuously provide invalid level.

When the first light-emitting element $LED_1$ in the pixel circuit fails to emit light normally, and the second light-emitting element $LED_2$ emits light normally, in combination with FIG. 9 and FIG. 11B, the operation sequence of the pixel circuit includes the following stages.

In the first stage S1, that is, an input stage, the input signal Gate is at a low level, so that the first transistor $M_1$, the second transistor $M_2$ and the fourth transistor $M_4$ are turned on. The driving data signal Data_L applied to the control electrode of the driving transistor DTFT is at a low level, so that the driving transistor DTFT is turned on and outputs driving current. The first repair data signal Data_R1 is at a low level, and the low level is applied to the first node $N_1$, so that the third transistor $M_3$ is turned on. The driving current flows through the third transistor $M_3$ turned on, so as to short circuit the first light-emitting element $LED_1$. The second repair data signal Data_R2 is at a high level, and the high level is applied to the second node $N_2$, so that the fifth transistor $M_5$ is turned off. The driving current flows through the second light-emitting element $LED_2$, so that the second light-emitting element $LED_2$ emits light.

In the second stage S2, that is, a light-emitting stage, both the first repair data signal Data_R1 and the second repair data signal Data_R2 are at a high level, and the input signal Gate is at a high level, so that the first transistor $M_1$, the second transistor $M_2$ and the fourth transistor $M_4$ are turned off. The driving transistor DTFT is still turned on under the action of the first capacitor $C_1$ and outputs the driving current. The third transistor $M_3$ is still turned on under the action of the second capacitor $C_2$. The fifth transistor $M_5$ is stilled turned off under the action of the third capacitor $C_3$. The driving current still flows through the third transistor $M_3$ turned on and the second light-emitting element $LED_2$, so that the second light-emitting element $LED_2$ emits light.

When the first light-emitting element $LED_1$ in the pixel circuit emits light normally, and the second light-emitting element $LED_2$ fails to emit light normally, in combination with FIG. 9 and FIG. 11C, the operation sequence of the pixel circuit includes the following stages.

In the first stage S1, that is, the input stage, the input signal Gate is at a low level, so that the first transistor $M_1$, the second transistor $M_2$ and the fourth transistor $M_4$ are turned on. The driving data signal Data_L applied to the control electrode of the driving transistor DTFT is at a low level, so that the driving transistor DTFT is turned on to output the driving current. The first repair data signal Data_L is at a high level, and the high level is applied to the first node $N_1$, so that the third transistor $M_3$ is turned off. The driving current flows through the first light-emitting element $LED_1$, so that the first light-emitting element $LED_1$ emits light. The second repair data signal Data_R2 is at a low level, and the low level is applied to the second node $N_2$, so that the fifth transistor $M_5$ is turned on. The driving current flows through the fifth transistor $M_5$ turned on, so as to short circuit the second light-emitting element $LED_2$.

In the second stage S2, that is, the light-emitting stage, both the first repair data signal Data_R1 and the second repair data signal Data_R2 are at a high level, and the input signal Gate is at a high level, so that the first transistor $M_1$, the second transistor $M_2$ and the fourth transistor $M_4$ are turned off. The driving transistor DTFT is still turned on under the action of the first capacitor $C_1$ and outputs the driving current. The third transistor $M_3$ is still turned off under the action of the second capacitor $C_2$. The fifth transistor $M_5$ is stilled turned on under the action of the third capacitor $C_3$. The driving current still flows through the first light-emitting element $LED_1$ and the fifth transistor $M_5$ turned on, so that the first light-emitting element $LED_1$ emits light.

When part of light-emitting elements in the pixel circuit fail to emit light normally, the repair data signal corresponding to the light-emitting element that fails to emit light normally and the driving scanning signal are valid level signals at the same time, and the repair data signal corresponding to the light-emitting element that emits light normally is continuously enabled. It should be noted that this embodiment is described with N=2 as an example. When N is greater than 2, if the $i^{th}$ light-emitting element LED in the pixel circuit fails to emit light normally, the repair data signal corresponding to the $i^{th}$ light-emitting element LED is identical with the input signal Gate.

Figure 12A:
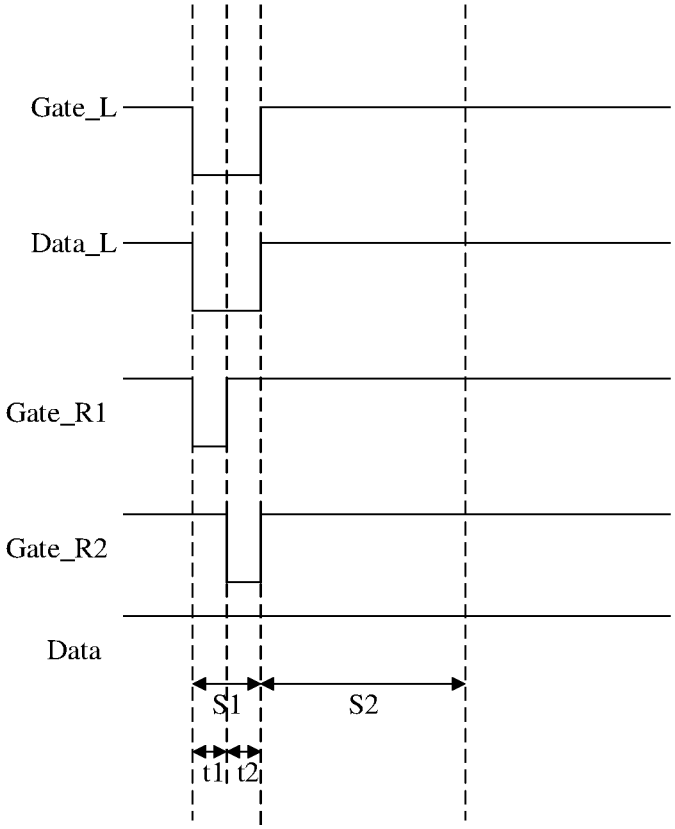
FIG. 12A shows an operation sequence diagram of the pixel circuit provided in FIG. 10 in which two light-emitting elements emit light normally.
Figure 12B:
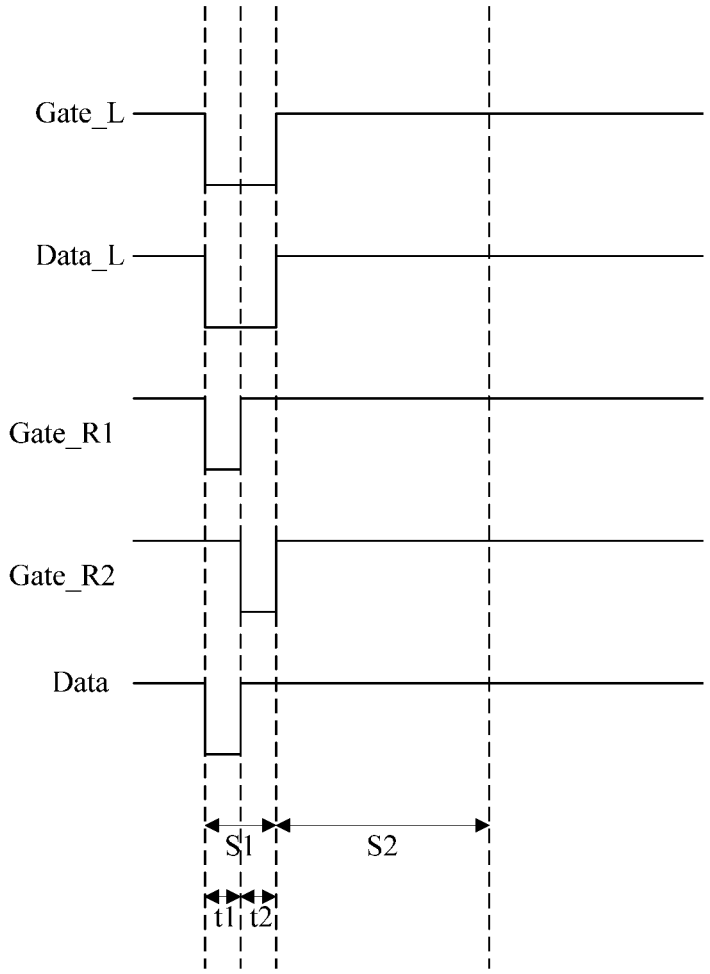
FIG. 12B shows an operation sequence diagram of the pixel circuit provided in FIG. 10 in which only a second light-emitting element is capable of emitting light normally.
Figure 12C:
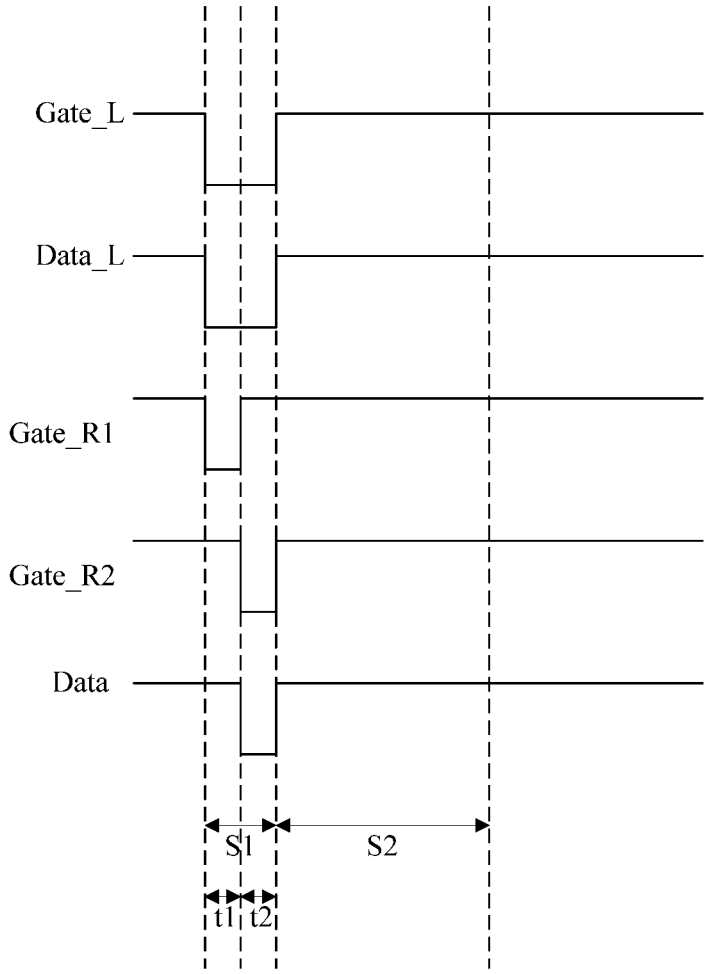

Taking the pixel circuit provided in FIG. 10 as an example, where N=2 and transistors $M_1$ to $M_5$ are all P-type thin film transistors, FIG. 12A shows an operation sequence diagram of the pixel circuit provided in FIG. 10 in which two light-emitting elements emit light normally, FIG. 12B shows an operation sequence diagram of the pixel circuit provided in FIG. 10 in which only a second light-emitting element is capable of emitting light normally, and FIG. 12C shows an operation sequence diagram of the pixel circuit provided in FIG. 10 in which only a first light-emitting element is capable of emitting light normally.

When both the light-emitting elements $LED_1$ and $LED_2$ in the pixel circuit emit light normally, in combination with FIG. 10 and FIG. 12A, the operation sequence of the pixel circuit includes a first stage S1 and a second stage S2.

The first stage S1, that is, an input stage, includes a first sub-stage t1 and a second sub-stage t2.

In the first sub-stage t1, the driving scanning signal Gate_L is at a low level, so that the first transistor $M_1$ is turned on. The low level of the driving data signal Data_L is applied to the control electrode of the driving transistor DTFT, so that the driving transistor DTFT is turned on and outputs the driving current. The input signal Data is at a high level, and the first repair scanning signal Gate_R1 is at a low level, so that the second transistor $M_2$ is turned on, the high level is provided to the first node $N_1$, and the third transistor $M_3$ is turned off. The second repair scanning signal Gate_R2 is at a high level, so that the fourth transistor $M_4$ and the fifth transistor $M_5$ are turned off. The driving current flows through the first light-emitting element $LED_1$ and the second light-emitting element $LED_2$, so that both the first light emitting element $LED_1$ and the second light emitting element $LED_2$ emit light.

In the second sub-stage t1, the driving scanning signal Gate_L is at a low level, so that the first transistor $M_1$ is turned on. The driving data signal Data_L is at a low level, and the low level is applied to the control electrode of the driving transistor DTFT, so that the driving transistor DTFT is turned on and outputs the driving current. The input signal Data is at a high level, and the first repair scanning signal Gate_R1 is at a high level, so that the second transistor $M_2$ is turned off. The third transistor $M_3$ is still turned off under the action of the second capacitor $C_2$. The second repair scanning signal Gate_R2 is at a low level, so that the fourth transistor $M_4$ is turned on. The high level is provided to the second node $N_2$, so that the fifth transistor $M_5$ is turned off. The driving current flows through the first light-emitting element $LED_1$ and the second light-emitting element $LED_2$, so that both the first light emitting element $LED_1$ and the second light emitting element $LED_2$ emit light.

In the second stage S2, that is, a light-emitting stage, both the driving data signal Data_L and the driving scanning signal Gate_L are at a high level. The driving transistor DTFT is turned on under the action of the first capacitor $C_1$ and outputs the driving current. The input signal Data, the first repair scanning signal Gate_R1 and the second repair scanning signal Gate_R2 are at a high level, so that the second transistor $M_2$ and the fourth transistor $M_4$ are turned off. The third transistor $M_3$ is turned off under the action of the second capacitor $C_2$. The fifth transistor $M_5$ is turned off under the action of the third capacitor $C_3$. The driving current flows through the first light-emitting element $LED_1$ and the second light-emitting element $LED_2$, so that both the first light-emitting element $LED_1$ and the second light-emitting element $LED_2$ emit light.

When both the light-emitting elements in the pixel circuit emit light normally, the input signal Data is continuously at a high level, the driving scanning signal Gate_L is a pulse signal with an effective level duration of T, and the first repair scanning signal Gate_R1 and the second repair scanning signal Gate_R2 are pulse signals with an effective level duration of T/2. It should be noted that this embodiment is described with N=2 as an example. When N is greater than 2 and all N light-emitting elements in the pixel circuit emit light normally, the input signal Data is continuously at a high level, and the effective level duration of each repair scanning pulse signal is T/N.

When the first light-emitting element $LED_1$ in the pixel circuit fails to emit light normally, and the second light-emitting element $LED_2$ emits light normally, in combination with FIG. 10 and FIG. 12B, the operation sequence of the pixel circuit includes a first stage S1 and a second stage S2.

The first stage S1, that is, the input stage, includes a first sub-stage t1 and a second sub-stage t2.

In the first sub-stage t1, the driving scanning signal Gate_L is a low-level signal, so that the first transistor $M_1$ is turned on. The low level of the driving data signal Data_L is applied to the control electrode of the driving transistor DTFT, so that the driving transistor DTFT is turned on and outputs the driving current. The input signal Data is at a low level, and the first repair scanning signal Gate_R1 is at a low level, so that the second transistor $M_2$ is turned on, the low level is applied to the first node $N_1$, and the third transistor $M_3$ is turned on. The driving current flows through the third transistor $M_3$ turned on, so as to short circuit the first light-emitting element $LED_1$. The second repair scanning signal Gate_R2 is at a high level, so that the fourth transistor $M_4$ and the fifth transistor $M_5$ are turned off. The driving current flows through the second light-emitting element $LED_2$, so that the second light-emitting element $LED_2$ emits light.

In the second sub-stage t1, the driving scanning signal Gate_L is at a low level, so that the first transistor $M_1$ is turned on. The driving data signal Data_L is at a low level, and the low level is applied to the control electrode of the driving transistor DTFT, so that the driving transistor DTFT is turned on and outputs the driving current. The input signal Data is at a high level. The first repair scanning signal Gate_R1 is at a high level, so that the second transistor $M_2$ is turned off. The third transistor $M_3$ is still turned on under the action of the second capacitor $C_2$. The driving current flows through the third transistor $M_3$ turned on, so as to short circuit the first light-emitting element $LED_1$. The second repair scanning signal Gate_R2 is at a low level, so that the fourth transistor $M_4$ is turned on. The high level is applied to the second node $N_2$, so that the fifth transistor $M_5$ is turned off. The driving current flows through the second light-emitting element $LED_2$, so that the second light-emitting element $LED_2$ emits light.

In the second stage S2, that is, the light-emitting stage, both the driving data signal Data_L and the driving scanning signal Gate_L are at a high level. The driving transistor DTFT is turned on under the action of the first capacitor $C_1$ and outputs the driving current. The input signal Data, the first repair scanning signal Gate_R1 and the second repair scanning signal Gate_R2 are at a high level, so that the second transistor $M_2$ and the fourth transistor $M_4$ are turned off. The third transistor $M_3$ is turned on under the action of the second capacitor $C_2$. The fifth transistor $M_5$ is turned off under the action of the third capacitor $C_3$. The driving current flows through the third transistor $M_3$ turned on and the second light-emitting element $LED_2$, so that the second light-emitting element $LED_2$ emits light.

When the first light-emitting element $LED_1$ in the pixel circuit emits light normally, and the second light-emitting element $LED_2$ fails to emit light normally, in combination with FIG. 10 and FIG. 12C, the operation sequence of the pixel circuit includes a first stage S1 and a second stage S2.

The first stage S1, that is, the input stage, includes a first sub-stage t1 and a second sub-stage t2.

In the first sub-stage t1, the driving scanning signal Gate_L is a low-level signal, so that the first transistor $M_1$ is turned on. The low level of the driving data signal Data_L is applied to the control electrode of the driving transistor DTFT, so that the driving transistor DTFT is turned on and outputs the driving current. The input signal Data is at a high level, and the first repair scanning signal Gate_R1 is at a low level, so that the second transistor $M_2$ is turned on, the high level is applied to the first node $N_1$, and the third transistor $M_3$ is turned off. The second repair scanning signal Gate_R2 is at a high level, so that the fourth transistor $M_4$ and the fifth transistor $M_5$ are turned off.

In the second sub-stage t2, the driving scanning signal Gate_L is at a low level, so that the first transistor $M_1$ is turned on. The driving data signal Data_L is at a low level, and the low level is applied to the control electrode of the driving transistor DTFT, so that the driving transistor DTFT is turned on and outputs the driving current. The input signal Data is at a low level, and the first repair scanning signal Gate_R1 is at a high level, so that the second transistor $M_2$ is turned off. The third transistor $M_3$ is still turned off under the action of the second capacitor $C_2$. The driving current flows through the first light-emitting element $LED_1$, so that the first light-emitting element $LED_1$ emits light. The second repair scanning signal Gate_R2 is at a low level, so that the fourth transistor $M_4$ is turned on. The low level is applied to the second node $N_2$, so that the fifth transistor $M_5$ is turned on. The driving current flows through the fifth transistor $M_5$ turned on, so as to short circuit the second light-emitting element $LED_2$.

In the second stage S2, that is, the light-emitting stage, both the driving data signal Data_L and the driving scanning signal Gate_L are at a high level. The driving transistor DTFT is turned on under the action of the first capacitor $C_1$ and outputs the driving current. The input signal Data, the first repair scanning signal Gate_R1 and the second repair scanning signal Gate_R2 are at a high level, so that the second transistor $M_2$ and the fourth transistor $M_4$ are turned off. The third transistor $M_3$ is turned off under the action of the second capacitor $C_2$. The fifth transistor $M_5$ is turned on under the action of the third capacitor $C_3$. The driving current flows through the first light-emitting element $LED_1$ and the fifth transistor $M_5$ turned on, so that the first light-emitting element $LED_1$ emits light.

When part of light-emitting elements in the pixel circuit fails to emit light normally, the repair scanning signal corresponding to each light-emitting element is identical with the input signal in the case where all the light-emitting elements in the pixel circuit emit light normally. The difference is that the input signal Data is no longer continuously at a high level, but a pulse signal. The effective level duration of the pulse signal of the input signal Data is a set of that when the repair scanning signals corresponding to the light-emitting elements that fail to emit light normally are valid input signals.

Figure 13:
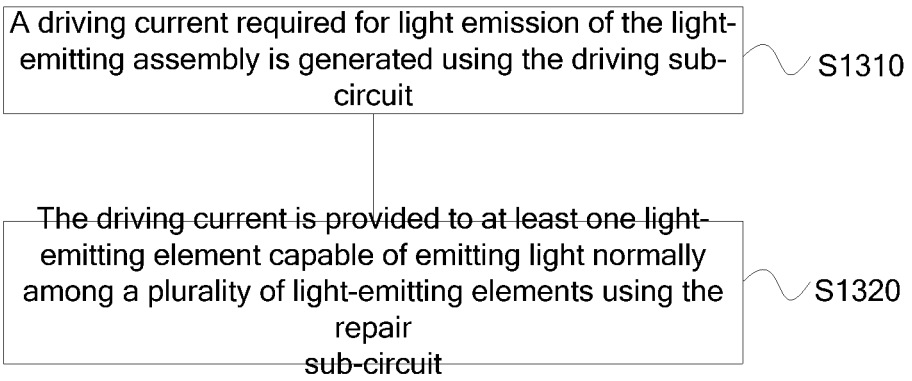
FIG. 13 shows a flowchart of a driving method of a pixel circuit provided by an embodiment of the present disclosure.

Based on the inventive concept of the embodiments mentioned above, some embodiments of the present disclosure further provide a driving method of a pixel circuit. FIG. 13 shows a flowchart of the driving method of the pixel circuit provided by an embodiment of the present disclosure. As shown in FIG. 13, a driving method 130 of the pixel circuit provided by the embodiment of the present disclosure includes the following steps.

Step S1310: A driving current required for light emission of the light-emitting assembly is generated using the driving sub-circuit.

Step S1320, The driving current is provided to at least one light-emitting element capable of emitting light normally among a plurality of light-emitting elements using the repair sub-circuit.

According to the embodiment, step S1310 includes: for each light-emitting element, in a state where the light-emitting element emits light normally, it is configured to provide the driving current to the light-emitting element under the control of a repair data signal and a repair scanning signal, and in a state where the light-emitting element fails to emit light normally, it is configured to short circuit the light-emitting element under the control of the repair data signal and the repair scanning signal.

The driving method of the pixel circuit provided in the embodiment of the present disclosure is applied to the pixel circuit provided in the foregoing embodiment. It has similar implementation principles and effects, which will not be repeated here.

Based on the inventive concept of the embodiments above, some embodiments of the present disclosure provide a display device. The display device provided by the embodiments of the present disclosure includes a plurality of sub-pixels, each including a pixel circuit.

According to the embodiments, the display device may be any product or component with a display function, such as a mobile phone, a tablet computer, a television, a monitor, a notebook computer, a digital photo frame, a navigator, and so on.

According to the embodiments, the pixel circuit is the pixel circuit provided in the foregoing embodiment. It has similar implementation principles and effects, which will not be repeated here.

Figure 14:
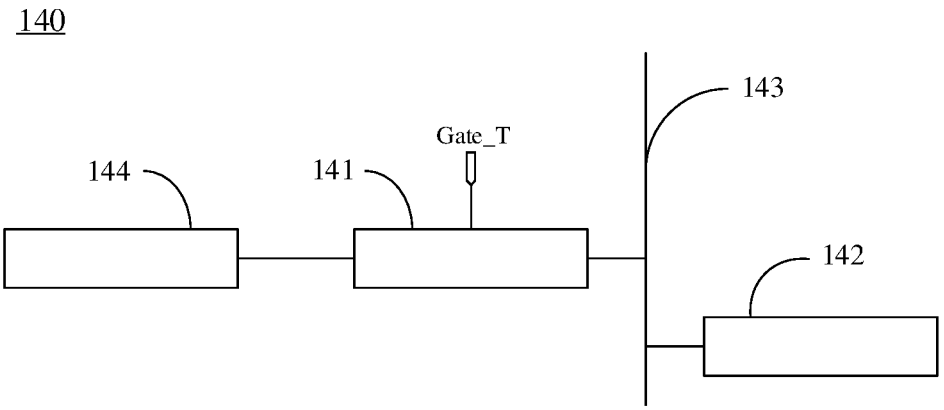
FIG. 14 shows a schematic structural diagram of a display device provided by an embodiment of the present disclosure.
Figure 15:
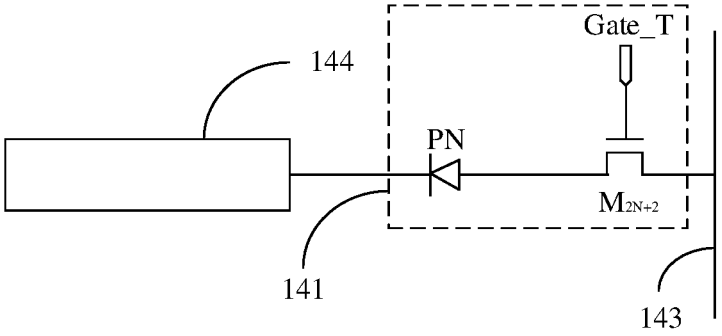
FIG. 15 shows a schematic structural diagram of a detecting module provided by an embodiment of the present disclosure.

FIG. 14 shows a schematic structural diagram of the display device provided by an embodiment of the present disclosure. FIG. 15 shows a schematic structural diagram of a detecting module provided by an embodiment of the present disclosure.

As shown in FIGS. 14 and 15, a display device 140 provided by the embodiments of the present disclosure includes a detecting module 141, a control module 142, a signal read line 143, and a pixel circuit 144.

As shown in FIG. 14, the detecting module 141 is electrically coupled to the pixel circuit 144 and the signal read line 143, respectively. The detecting module 141 is configured to receive a detection scanning signal Gate_T, and output a detected current corresponding to a brightness of the pixel circuit 144 to the signal read line 143 under the control of the detection scanning signal Gate_T. The control module 142 is electrically coupled to the signal read line 143, and is configured to determine whether the sub-pixel corresponding to the pixel circuit 144 emits light normally according to the detected current. The control module 142 is further configured to identify a light-emitting element that fails to emit light normally in the sub-pixel in a state where the sub-pixel fails to emit light normally, and control a generation of N repair scanning signals and N repair data signals, so as to provide the driving current to the $i^{th}$ light-emitting element in a state where the $i^{th}$ light-emitting element emits light normally, or short circuit the $i^{th}$ light-emitting element in a state where the $i^{th}$ light-emitting element fails to emit light normally.

According to an embodiment, the detecting module 141 may be provided in the sub-pixel.

In this embodiment, the control module determines whether the sub-pixel corresponding to the pixel circuit emits light normally or not based on a magnitude of the detected current of the detecting module. Specifically, the detected current of the detecting module is compared with a pre-stored reference current. In a state where the detected current of the detecting module is less than the pre-stored reference current, the sub-pixel corresponding to the pixel circuit fails to emit light normally. In the state where the sub-pixel corresponding to the pixel circuit fails to emit light normally, the control module provides an invalid repair scanning signal and an invalid repair data signal to the $i^{th}$ light-emitting element, that is, the driving current flows through the $i^{th}$ light-emitting element, and provides valid repair scanning signals and repair data signals to the other light-emitting elements, that is, the other light-emitting elements are short circuit. If the $i^{th}$ light-emitting element is capable of emitting light normally, then only the $i^{th}$ light-emitting element in the light-emitting assembly emits light. If the $i^{th}$ light-emitting element fails to emit light normally, the light-emitting assembly does not emit light. The control module may identify the light-emitting element that is capable of emitting light normally and the light-emitting element that fails to emit light normally in the sub-pixel according to the magnitude of the detected current of a detection circuit.

As shown in FIG. 15, the detecting module 141 provided by the embodiment of the present disclosure includes a $(2N+2)^{th}$ transistor $M_{2N+2}$ and a photodiode PN.

As shown in FIG. 15, the $(2N+2)^{th}$ transistor $M_{2N+2}$ has a control electrode electrically coupled to receive the detection scanning signal Gate_T, a first electrode electrically coupled to an anode of the photodiode PN, and a second electrode electrically coupled to the signal read line 143. A cathode of the photodiode PN is electrically coupled to the second power supply VSS in the pixel circuit 144. The photodiode PN is used to convert light into current, and different light intensity corresponds to different current intensity.

According to the embodiment, the detecting module may also be an external device, for example, an Automated Optical Inspection (AOI) device. The Automated Optical Inspection (AOI) device detects the light-emitting element that fails to emit light normally by the method of taking photos or optical recognition, and records position information thereof. The control module controls N repair scanning signals and N repair data signals according to the position information of the detecting module, so as provide the driving current to the $i^{th}$ light-emitting element in the state where the $i^{th}$ light-emitting element emits light normally, or short circuit the $i^{th}$ light-emitting element in the state where the $i^{th}$ light-emitting element fails to emit light normally.

The drawings of the embodiments of the present disclosure only refer to the structures involved in the embodiments of the present disclosure, and other structures may refer to usual designs.

Although the embodiments disclosed in the present disclosure are described as above, the contents described are only the embodiments used to facilitate the understanding of the present disclosure, and are not intended to limit the present disclosure. Any person skilled in the art of the present disclosure may make any modifications and changes in the implementation form and details without departing from the spirit and scope of the present disclosure. However, the patent protection scope of the present disclosure is still be determined by the scope defined by the appended claims.

The invention claimed is:

1. A pixel circuit, comprising:

a light-emitting assembly comprising a plurality of light-emitting elements;

a driving sub-circuit electrically coupled to the light-emitting assembly and configured to generate driving current for driving the light-emitting assembly to emit light; and a repair sub-circuit electrically coupled to the light-emitting assembly and configured to: receive a repair scanning signal and a repair data signal, and provide the driving current to at least one light-emitting element capable of emitting light normally among the plurality of light-emitting elements under the control of the repair scanning signal and the repair data signal, to enable the light-emitting assembly to emit light in the presence of a malfunctioning light-emitting element in the plurality of light-emitting elements, wherein the plurality of light-emitting elements are coupled in series.

2. The pixel circuit according to claim 1, wherein the light-emitting element comprises a Micro light-emitting diode or a Mini light-emitting diode.

3. The pixel circuit according to claim 1, wherein the driving sub-circuit comprises a first transistor, a driving transistor and a first capacitor; wherein the first transistor has a control electrode electrically coupled to receive a driving scanning signal, a first electrode electrically coupled to receive a driving data signal, and a second electrode electrically coupled to a control electrode of the driving transistor;

the driving transistor has the control electrode electrically coupled to a first end of the first capacitor, a first electrode electrically coupled to the light-emitting assembly, and a second electrode electrically coupled to a first power supply; and the first capacitor has a second end electrically coupled to the first power supply.

4. The pixel circuit according to claim 1, wherein the light-emitting assembly comprises N light-emitting elements, and the repair sub-circuit comprises N repair modules corresponding to the N light-emitting elements one-to-one; an $i^{th}$ repair module is configured to receive an $i^{th}$ repair scanning signal and an $i^{th}$ repair data signal, and provide the driving current to an $i^{th}$ light-emitting element under the control of the $i^{th}$ repair scanning signal and the $i^{th}$ repair data signal, where N is a natural number greater than 1, and $1 \leq i \leq N$.

5. The pixel circuit according to claim 4, wherein the $i^{th}$ repair module comprises:

a node control unit electrically coupled to a light-emitting control unit and configured to: receive the $i^{th}$ repair scanning signal and the $i^{th}$ repair data signal, generate a light-emitting control signal based on the $i^{th}$ repair scanning signal and the $i^{th}$ repair data signal, and provide the light-emitting control signal to the light-emitting control unit; and the light-emitting control unit coupled in parallel to both ends of the $i^{th}$ light-emitting element and configured to: receive the light-emitting control signal, and control the driving current to flow through the $i^{th}$ light-emitting element or short circuit the $i^{th}$ light-emitting element under the control of the light-emitting control signal.

6. The pixel circuit according to claim 5, wherein the node control unit of the $i^{th}$ repair module comprises a $(2i)^{th}$ transistor and an $(i+1)^{th}$ capacitor; wherein the $(2i)^{th}$ transistor has a control electrode electrically coupled to receive the $i^{th}$ repair scanning signal, a first electrode electrically coupled to receive the $i^{th}$ repair data signal, and a second electrode electrically coupled to a first end of the $(i+1)^{th}$ capacitor; and the $(i+1)^{th}$ capacitor has a second end electrically coupled to the first power supply.

7. The pixel circuit according to claim 6, wherein the light-emitting control unit comprises a $(2i+1)^{th}$ transistor; and wherein the $(2i+1)^{th}$ transistor has a control electrode electrically coupled to the second electrode of the $(2i)^{th}$ transistor, a first electrode electrically coupled to an anode of the $i^{th}$ light-emitting element, and a second electrode electrically coupled to a cathode of the $i^{th}$ light-emitting element.

8. The pixel circuit according to claim 6, wherein control electrodes of the $(2i)^{th}$ transistors of the plurality of repair modules are electrically coupled to a control electrode of a first transistor of the driving sub-circuit.

9. The pixel circuit according to claim 6, wherein first electrodes of the $(2i)^{th}$ transistors of the plurality of repair modules are electrically coupled together.

10. A driving method of the pixel circuit according to claim 1, comprising:

generating, by a driving sub-circuit, driving current for driving a light-emitting assembly to emit light; and providing, by a repair sub-circuit, the driving current to at least one light-emitting element capable of emitting light normally among a plurality of light-emitting elements.

11. A display device comprising a plurality of sub-pixels each comprising the pixel circuit according to claim 1.

12. The display device according to claim 11, further comprising:

a signal read line;

a detecting module electrically coupled to the pixel circuit and the signal read line, and configured to output detected current to the signal read line, wherein the detected current corresponds to a brightness of the sub-pixel corresponding to the pixel circuit; and a control module electrically coupled to the signal read line and configured to: identify a light-emitting state of each light-emitting element in the sub-pixel based on the detected current, and provide repair scanning signals and repair data signals to a plurality of repair modules of the pixel circuit based on the light-emitting state of each light-emitting element.

13. The display device according to claim 12, wherein the detecting module comprises a $(2N+2)^{th}$ transistor and a photodiode, where N is a natural number greater than 1; and wherein the $(2N+2)^{th}$ transistor has a control electrode electrically coupled to receive a detection scanning signal, a first electrode electrically coupled to an anode of the photodiode, and a second electrode electrically coupled to the signal read line; and the photodiode has a cathode electrically coupled to a second power supply.

* * * * *